United States Patent [19]

Lockard

[11] 4,000,383

[45] Dec. 28, 1976

[54] ROCKER SWITCH HAVING SLIDABLE CONTACT CARRIAGE BIASED BY POSITIVE DETENT STRUCTURE

[75] Inventor: Joseph LaRue Lockard, Harrisburg, Pa.

[73] Assignee: AMP Incorporated, Harrisburg, Pa.

[22] Filed: June 20, 1975

[21] Appl. No.: 588,741

[52] U.S. Cl. ..... 200/16 D; 200/295; 200/339

[51] Int. Cl.[2] ..... H01H 15/00; H01H 3/50

[58] Field of Search ..... 200/16 C, 16 D, 291, 200/293–296, 303, 339, 16 R, 153 R

[56] References Cited

UNITED STATES PATENTS

| | | | |
|---|---|---|---|
| 2,868,930 | 1/1959 | Pistey et al. | 200/16 R X |
| 3,271,535 | 9/1966 | Vananzi | 200/16 C |
| 3,287,513 | 11/1966 | McFarland | 200/16 C |
| 3,614,346 | 10/1971 | Gudaitis et al. | 200/339 X |
| 3,643,046 | 2/1972 | Zdanys, Jr. et al. | 200/16 D X |
| 3,673,365 | 6/1972 | Schadow | 200/16 R |
| 3,681,556 | 10/1971 | Osika | 200/339 X |
| 3,800,113 | 3/1974 | Sheahan | 200/295 |
| 3,858,012 | 12/1974 | Lockard | 200/339 X |
| 3,878,344 | 4/1975 | Lockard | 200/241 X |
| 3,914,570 | 10/1975 | Lockard | 200/16 D X |

*Primary Examiner*—James R. Scott
*Attorney, Agent, or Firm*—Gerald K. Kita

[57] ABSTRACT

A rocker action switch is disclosed of dip configuration to be pluggably mounted in a printed circuit board or mounted to a panel with clips. A carriage having bridging contacts is slidably displaced within the housing to selectively engage the bridging contacts with selected switch poles. A pivotable control knob has a projecting lever that engages and slidably actuates the carriage. The switch may be constructed with interchangeable parts to perform various switching functions such as momentary, double-pole single-throw or double-pole double-throw with positive detent action. Assembly of the switch is simplified by vertically stacking the component parts within the housing.

2 Claims, 7 Drawing Figures

ROCKER SWITCH HAVING SLIDABLE CONTACT CARRIAGE BIASED BY POSITIVE DETENT STRUCTURE

FIELD OF THE INVENTION

The present invention relates to a manually actuated switch in a dual-in-line package (DIP) configuration, and more particularly to a rocker actuated switch wherein the component parts thereof are interchangeable and readily assembled in vertically stacked relationship to provide a wide variation in switch operations and pluggable assembly in a bulkhead or on a printed circuit board.

SUMMARY OF THE INVENTION

A manually actuated switch of miniature size is disclosed with the switch poles being formed by electrical terminals arranged in two rows in a housing of dual-in-line package configuration. The carriage is slidably mounted in the housing and carries bridging contacts which electrically bridge across selected switch poles when the carriage is slidably traversed within the housing. The switch includes a control knob in the form of a rocker which is pivotably mounted to the housing. The control knob includes a projecting lever which engages the carriage and forces it to slidably traverse within the housing. The control knob further includes projecting flange portions providing positive stops to limit pivotable displacement. A leaf spring within the housing registers within selected detents of the carriage to provide positive detenting and positioning of the carriage in selected positions. An optional coil spring assembled in the housing positively biases the carriage to a selected position and is resiliently compressible upon displacement of the carriage from its selected position. Optional spring clips interfit with complimentary geometry of the housing to permit bulkhead mounting of the switch. All of the component parts of the switch are interchangeable and are readily assembled in stacked relationship without a need for adhesives or fasteners, simplifying the assembly procedures required.

OBJECTS

Accordingly it is an object of the present invention to provide a DIP switch having the component parts thereof assembled in stacked relationship, with some of the parts being interchangeable to allow selection of a variety of switch operations.

Another object of the present invention is to provide a rocker switch of DIP configuration wherein a pivotable rocker includes a projecting portion which engages and slidably traverses a carriage within a housing such that bridging contacts of the carriage bridge across selected switch poles which are mounted in the housing in such a manner as to provide depending electrical leads of the DIP configuration.

Other objects and many attendant advantages of the present invention will become apparent upon perusal of the following detailed description taken in conjunction with the drawings.

DETAILED DESCRIPTION OF THE DRAWINGS

DETAILED DESCRIPTION OF THE INVENTION

Figure 1:
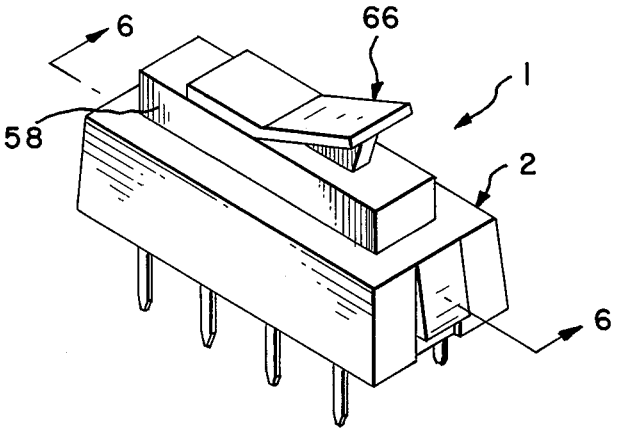
FIG. 1 is an enlarged perspective of a rocker type DIP switch according to the present invention.
Figure 4:
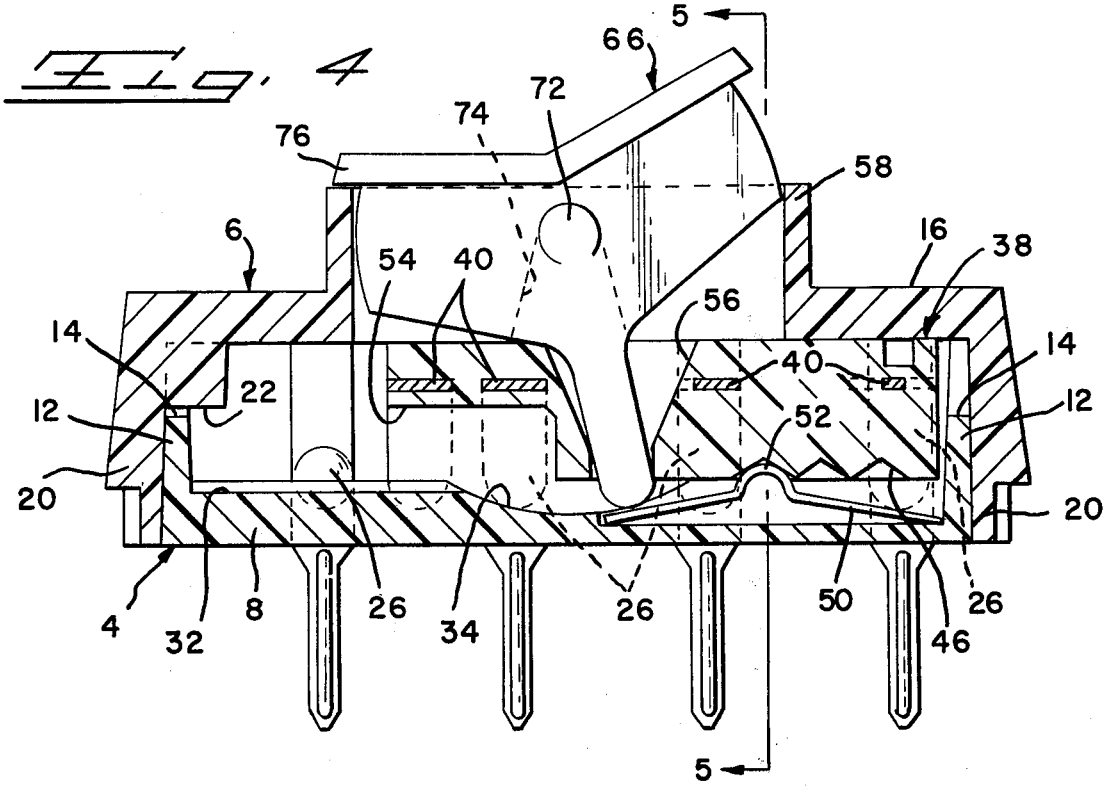
FIG. 4 is an enlarged elevation in section of a three position switch according to the present invention.
Figure 5:
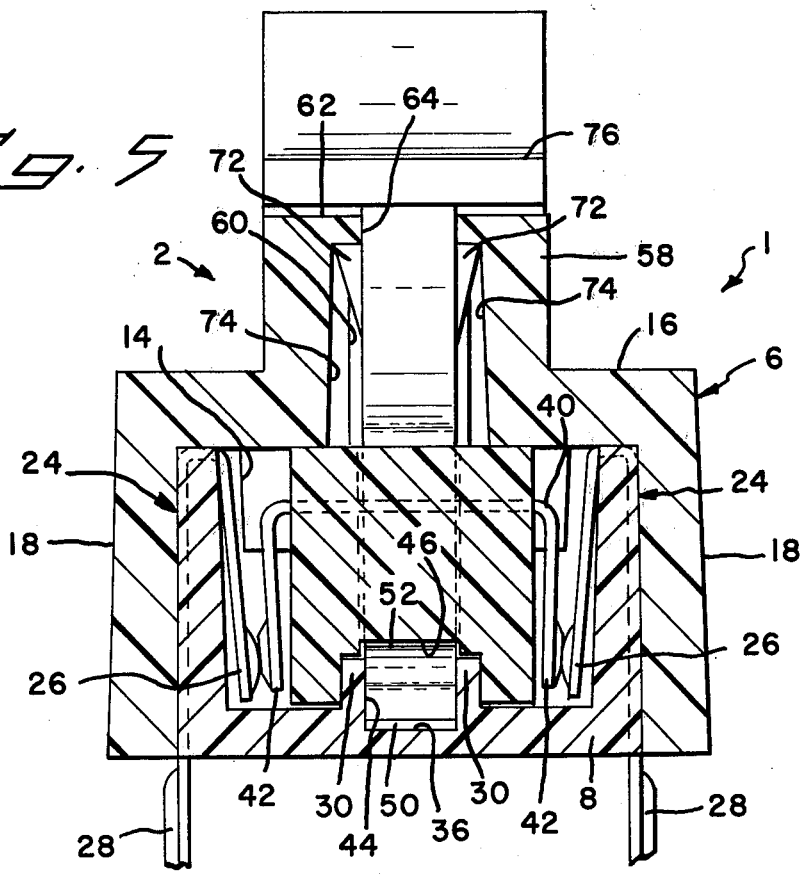
FIG. 5 is an enlarged section taken along the line 5—5 of FIG. 4.
Figure 6:
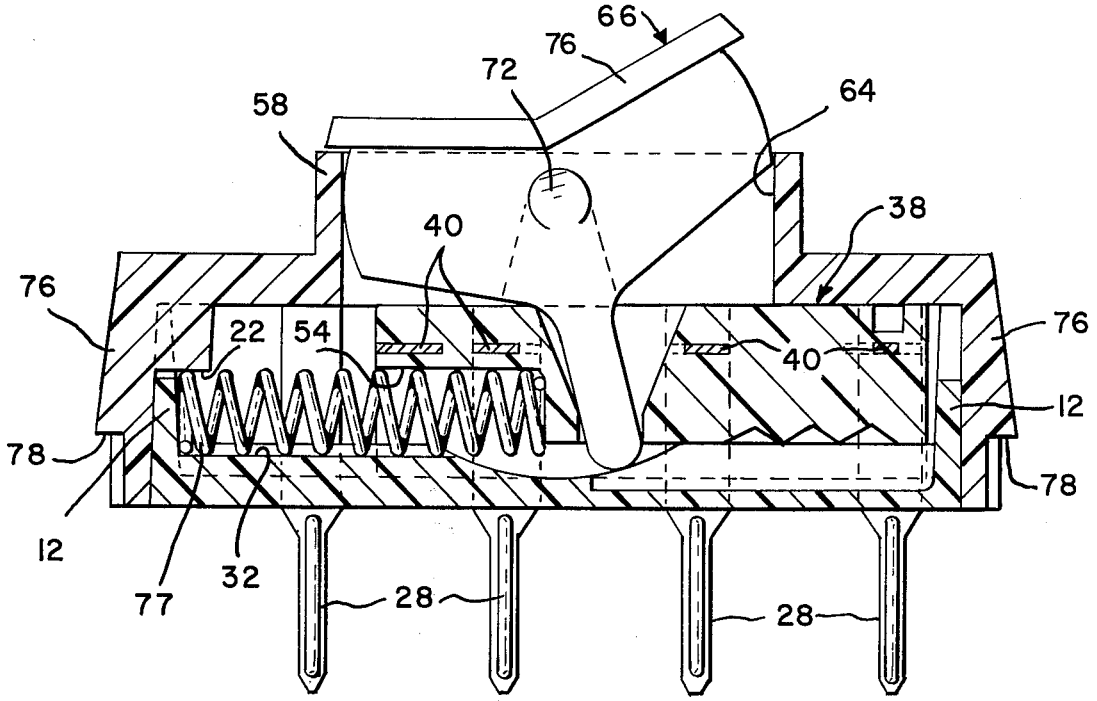
FIG. 6 is an enlarged section taken along the line 6—6 of FIG. 1.

With more particular reference to the drawings there is illustrated in FIGS. 1, 5 and 6 a preferred embodiment of a rocker type switch according to the present invention having a dielectric housing 2 comprised of a one piece molded base 4 and a one piece molded cover 6. Base 4 includes a bottom wall 8, a pair of spaced sidewalls 10 and endwalls 12 interconnecting the sidewalls 10. Each of the endwalls 12 includes a generally rectangular notch 14. The cover 6 is generally of inverted box form having a top surface 16 from which depend parallel sidewalls 18 and endwalls 20 connecting the sidewalls 18. When the cover and base are assembled an inverted shoulder portion 22 on the cover overlies one of the endwalls 12 and projects into an interior of the housing which interior is defined by the assembled cover and base. The housing sidewalls 10 are grooved to receive resilient leaf spring terminals 24 therein with first end portions 26 of the terminals hooked over the sidewalls to depend within the housing interior and second end portions 28 of the terminals depending from the bottom wall 8 of the base to provide two rows of spaced electrical leads in the familiar DIP configuration. The contact or terminal portions 26 also are arranged in opposed rows along the sidewalls 10. The bottom wall 8 of the base is provided with a pair of elongated rals 30 projecting in the housing interior from one endwall 12, and an arcuate bearing surface 32 in the housing interior and projecting from the other endwall 12. An arcuate depression 34 is interposed between the bearing surface 32 and the rails 30. A recessed groove 36 in the bottom wall 8 is defined between the rails. A carriage in the form of an elongated dielectric block is illustrated generally at 38 and includes a spaced plurality of inverted U-shaped contacts 40 having depending resiliently deflectable end portions 42 as shown in FIG. 5. The block 38 is advantageously molded around the contacts 40 and is further molded with an inverted groove 44 for slidably receiving the rails 30 therein. In one version of the switch shown in FIG. 4 the inverted bottom of the groove 44 is provided with three inverted V-shaped detents 46. In another version of the switch shown in FIG. 7 the inverted bottom of the groove is provided with two inverted V-shaped detents 48. A leaf spring 50 is received in the recessed groove 36. The spring 50 has an inverted V-shaped configuration with a projecting arcuate portion 52 at the apex of the V that detents in the corresponding recesses 46 or 48 of the carriage.

The carriage further is provided at one end with an inverted cutaway or relieved portion 54 which generally overlies the arcuate bearing surface 32 of the bottom wall 8. The carriage 38 further is provided with a vertical funneled shaped opening 56, at least two of the sides of which are oppositely diverging in a funnel shape. The housing 6 has its top portion 16 provided with a reduced stepped projecting portion 58 having a hollow interior 60 and a planar top wall 62. The wall 62 is provided with an elongated slot 64 communicating with the hollow interior 60. The invention further includes a manually actuated rocker illustrated generally at 66 which may be molded from a dielectric material. The rocker includes a main body portion 68 which is elongated and generally extends the entire length of the slot 64. The opposite ends of the body portion 68 are rounded or arcuate to allow pivotable displacement of the body portion within the slot 64. The body portion 68 further includes an integral depending finger or tongue 70 which is inserted into and freely received by the opening 56 of the carriage 38. The body portion 68 further includes integral generally arcuate axles 72. The axles 72, as shown in FIG. 5, are substantially wedge shaped or tapered in a direction toward the finger 70. This allows wedged insertion of the axles 72 forcibly through the slot 64 and into the hollow interior of the cover projecting portion 58. The cover material is sufficiently resilient to allow forcible insertion of the axles 72 without damage to the slot 64. The axles 72 thus are received into corresponding inverted and diverging U-shaped recesses 74 in the interior sidewalls of the housing portion 58. The axles 72 are thus rotatably received in the apexes of the recesses 74 to allow pivotable displacement of the rocker 66. The rocker 66 projects outwardly of the slot 64 and has a top surface defined by a projecting flange which is generally of obtuse V-shaped configuration. The flange laterally projects from the body portion 68 and is adapted to cover the top wall 62 like an umbrella.

In the switch embodiment illustrated in FIG. 6, an elongated resilient coil spring 77 is located lengthwise along the arcuate channel 32. One end of the spring engages against an endwall 12 and the other end of the spring is received in the recess 54 of the carriage 38 and is engaged against the carriage 38 biasing the same toward the opposite endwall 12. The cover portion 22 overlies the end of the spring 77 and provides thereby a keeper. In similar fashion the undercut portion 54 provides a keeper for the opposite end of the spring.

Figure 3:
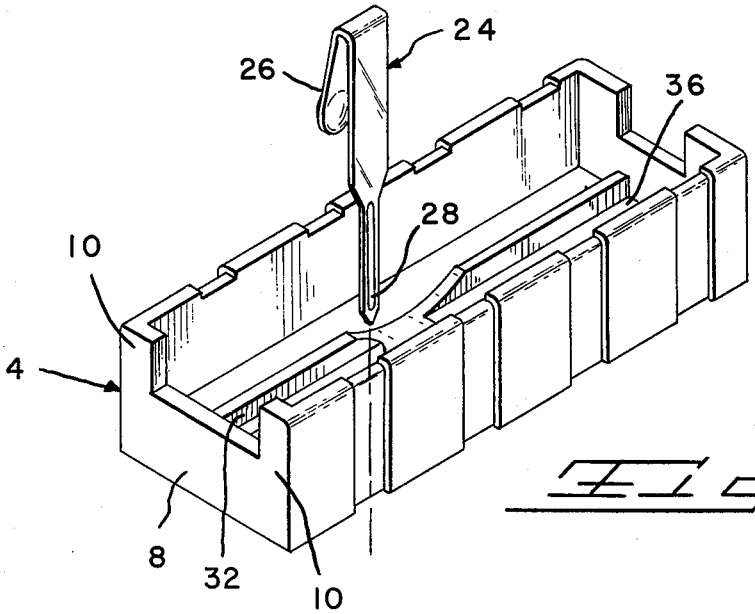
FIG. 3 is an enlarged perspective illustrating the stackable assembly of the switch poles and the housing.

To assemble any of the switch embodiments, first the terminals 24 are mounted over the housing sidewalls 10 as shown in FIG. 3. Then either a spring 50 or a spring 77 is selected and mounted within its respective position within the base 4. A carriage having either two detents 48 or three detents 48 is then assembled over the corresponding selected spring 50 or 77. Next the cover 6 is assembled over the housing in registration on the carriage thereby holding together the assembled parts in stacked relationship. The rocker 66 is then inserted through the slot 64 with the finger 70 in receipt within the opening 56 of the carriage 38. The rocker is latched into place upon the axles 72 registering within the recesses 74.

Operation of the FIG. 4 embodiment having three detents 46 is as follows. From left to right the four bridging contacts 40 are shown with the second, third and fourth contacts 40 respectively bridging between and interconnecting second, third and fourth opposed pairs of terminals 26. The left portion of the flange 76 is in stopped engagement against the top of the projecting portion 58 limiting clockwise pivotable motion of the rocker 66. The apex portion 52 of the spring 50 is detented in the leftmost detent 46. Clockwise pivotable motion of the rocker 66 displaces the carriage 38 from right to left whereby the apex portion 52 will register within the center one of the detents 46. In this position the second, third and fourth contacts 40 will bridge across corresponding first, second, third and fourth opposed pairs of terminals 26. Additional clockwise pivotable motion of the rocker 66 will engage the left portion of the flange 76 in stopped position against the portion 58 of the cover limiting clockwise rotation thereof. The carriage will be displaced until the apex portion 52 of the spring registers in the rightmost one of the detents 46. In this position the first contact 40 will remain bridged across the corresponding first opposed pair of terminals 26 while the remaining contacts 40 will become disengaged from the remaining second, third and fourth opposed pairs of terminals 26.

In the embodiment shown in FIG. 6, the coil spring 77 biases the carriage resiliently toward the right endwall 12 causing the left portion of the flange 66 to register in stopped engagement against the cover portion 58 limiting counterclockwise pivotable rotation thereof, as well as limiting displacement of the carriage from left to right within the housing. Clockwise manual pivoting of the rocker 66 displaces the carriage from right to left within the housing resiliently compressing spring 77. The right hand portion of the flange 76 will stop against the housing portion 58 to limit the clockwise rotation and the right to left displacement of the carriage. Upon manually releasing the rocker the spring 77 will resiliently expand to return the carriage to its position as shown in FIG. 6 thereby providing a momentary switch action. In the switch position shown in FIG. 6, the second, third, and fourth contacts 40 from left to right respectively bridge across second, third and fourth pairs of opposed terminals 28. Upon displacement of the carriage from right to left the first contact 40 will bridge across the first opposed pair of terminals 28 while the remaining contacts 40 will disengage from the second, third and fourth opposed pairs of terminals 28.

Figure 7:
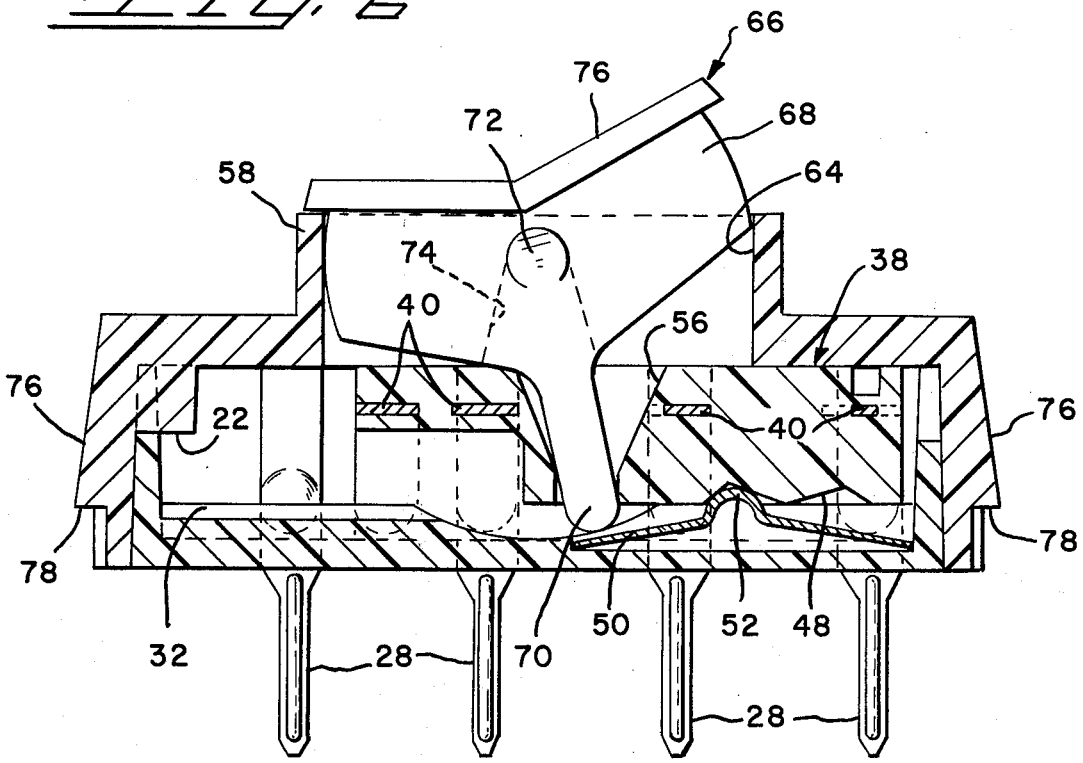
FIG. 7 is an enlarged section similar to FIG. 6 and illustrating a two position detented modification.

The switching operation of the FIG. 7 embodiment is substantially the same as in the embodiment of FIG. 6. In the position of the carriage as shown in FIG. 7 the second, third and fourth opposed pairs of terminals 28 are respectively bridged across by corresponding second, third and fourth contacts 40. The apex 52 of the spring 50 registers within the left detent 48 maintaining the carriage in position. Upon clockwise pivoting of the rocker 66 the carriage 38 is displaced from right to left to a position maintained by registration of the apex portion 52 within the right detent 48. In such position only the first pair of terminals 28 are bridged across by a corresponding first contact 40.

The depending terminals 28 of any of the disclosed embodiments form electrical leads for pluggably mounting the switch to a printed circuit board in the usual manner of utilizing a DIP package.

Figure 2:
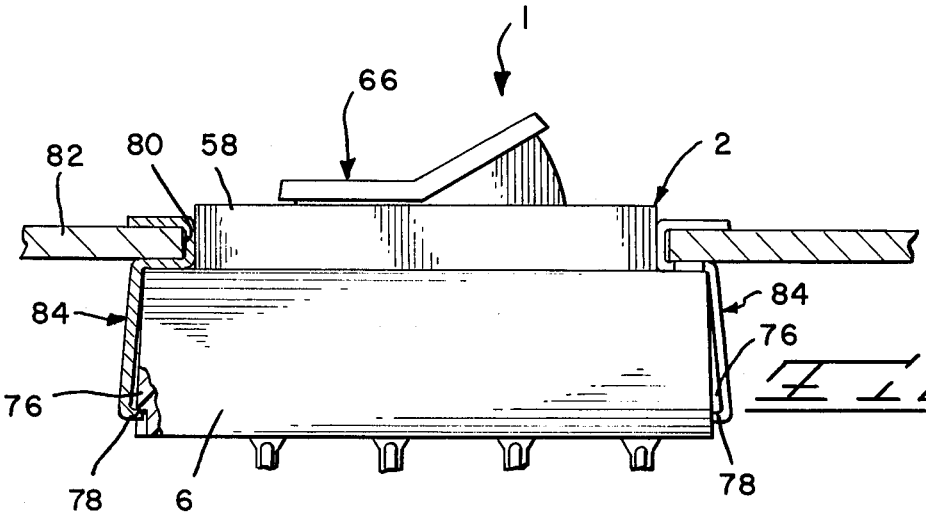
FIG. 2 is an enlarged elevation of the switch illustrated in FIG. 1 mounted to a bulkhead with spring clips.

The endwalls 12 of the housing are provided with wedge shaped projections 76 having inverted shoulders 78. As shown in FIG. 2 each of the switch embodiments may be adapted for mounting within an aperture 80 of a panel or bulkhead 82. This is accomplished by utilizing generally S-shaped spring clips 84 having oppositely directed channel shaped portions. First channel shaped portions are first hooked over the bulkhead within the aperture 80. Then the housing 2 of a selected switch embodiment has the projecting portion 58 thereof inserted within the aperture 80 engaging each of the spring clips 84 and preventing removal thereof from the aperture 80. The wedge shaped shoulders 76 are forcibly inserted into the second channel shaped portions of the spring clips 84 until the spring clips hook over the inverted shoulders 78 thereby retaining the housing 2 in mounted position within the aperture 80.

What has been described and shown are preferred embodiments of the present invention. Other embodiments and modifications thereof which would be apparent to one having ordinary skill in the art are intended to be covered by the spirit and scope of the appended claims.

What is claimed is:

1. In a switch having a base and interfitting cover defining a housing, with opposed rows of terminals on said base, a carriage in said housing slidable along said base and having at least one contact switchable across selected terminals, the improvement comprising:

an integral channel on said base, a coil spring or an inverted V-shaped spring alternately received in opposite ends of said channel, said carriage having a first end provided with a plurality of inverted recesses into which an apex of said inverted V-shaped spring detents as said carriage is slidably displaced along said channel as well as along said base, said carriage having a second end provided with an undercut portion serving as a keeper for said coil spring, said coil spring being resiliently compressed between an end wall of said base and said carriage as said carriage is slidably displaced along said channel as well as along said base, and operator means projecting through said cover for manually displacing said carriage.

2. The structure as recited in claim 1, and further including:

wedge shaped projecting shoulders on opposite enclosure walls of said housing, each shoulder provided thereon with a corresponding clip having oppositely directed channel portions, one channel portion in mating engagement on a corresponding shoulder and the other channel portion facing outwardly of said housing for mating engagement on a panel.

* * * * *